United States Patent [19]

Rau et al.

[11] 4,140,223

[45] Feb. 20, 1979

[54] TIERED ROTATABLE SPICE-CANS STORAGE UNIT

[76] Inventors: Arthur G. Rau; Regina M. Rau, both of 336 Valley Rd., Watchung, N.J. 07060

[21] Appl. No.: 827,222

[22] Filed: Aug. 24, 1977

[51] Int. Cl.[2] ..... A47F 3/10

[52] U.S. Cl. ..... 211/78; 211/131; 312/125

[58] Field of Search ..... 211/77, 78, 79, 80, 211/71, 131, 163; 108/94, 103, 26, 55.3; 312/125, 197, 202, 252, 285

[56] References Cited

U.S. PATENT DOCUMENTS

| | | | |
|---|---|---|---|
| 565,779 | 8/1896 | Murray | 312/125 X |
| 1,867,738 | 7/1932 | Fraser | 206/557 X |
| 1,892,349 | 12/1932 | Johnsen | 211/71 |
| 1,977,092 | 10/1934 | Scurlock | 211/77 |
| 1,978,695 | 10/1934 | Clark | 211/77 |
| 2,030,899 | 2/1936 | Scurlock | 211/77 |
| 2,074,564 | 3/1937 | Scurlock | 211/77 |
| 2,091,394 | 8/1937 | Park | 211/77 |
| 3,736,036 | 5/1973 | Mathus | 312/202 X |
| 3,862,787 | 1/1975 | Hilsinger | 312/125 X |
| 3,889,817 | 6/1975 | Berkman | 211/163 |
| 3,992,068 | 11/1976 | Galton | 211/78 X |

FOREIGN PATENT DOCUMENTS 2264595 5/1974 Fed. Rep. of Germany ..... 108/55.3

*Primary Examiner*—James T. McCall
*Assistant Examiner*—Robert W. Gibson, Jr.

[57] ABSTRACT

In a preferred embodiment, a support base having a detachably attached segmented upright structure of serially arranged rod members having pivotally-rotatably mounted therearound a multiplicity of tiers of pigeonhole structures, each pigeonhole structure forming a plurality of separate recess spaces each with its respective flat support surface and outer edge thereof located adjacent the insert opening to the recess space thereof, and for each flat support surface there being a set of at least one pair of upwardly-extending abutments including at least a first abutment positioned a first distance from the outer edge and a second abutment positioned a second distance from the outer edge, respectively preventing the sliding inwardly and outwardly of a spice can having a bottom peripheral downwardly-extending flange, and each recessed space extending along a first direction to its insert opening with the first direction substantially at right angle to a line along a second direction having the line of the second direction extending imaginarily through the upright structure.

2 Claims, 5 Drawing Figures

TIERED ROTATABLE SPICE-CANS STORAGE UNIT

This invention relates to a spice-can storage unit.

BACKGROUND TO THE INVENTION

Prior to the present invention, there have existed lazy-susan rotary storage units for various foods, as typified by patents such as Scurlock/U.S. Pat. No. 2,030,899 in which openings extend radially-outwardly in pie-shaped segments each with an outer-edge upwardly-extending edge-flange, and Park/U.S. Pat. No. 2,091,394 showing about the same as the Scurlock patent, and the Scurlock/U.S. Pat. No. 2,074,564 showing a tier structure, and the Scurlock/U.S. Pat. Nos. 1,977,092 showing a can-supporting variation, and Clark/U.S. Pat. No. 1,978,695 merely showing another general variation. However, none of these nor other known art provides any suitable shapes nor devices for the secure and economy-of-space storage conveniently of squared-cornered typically rectangularly-shaped spice cans of varying sizes and lengths. Also, a typical prior art arrangement of radially-outwardly -extending storage spaces does not lend itself to the spice-can shapes noted-above, as well as there being the problem of a short-length can being susceptable to being pushed-back too far into the storage space away from the inset opening, as well as being subject to slipping-out if too close to the outer edge particularly when the rotary support is rotated revolvably.

SUMMARY OF THE INVENTION

Accordingly, objects of the present invention include the overcoming and avoiding of problems and difficulties of the type discussed above, together with novel advantages and utilities.

Another object is to obtain a simple and inexpensive unit obtaining the above objects.

Another object is to reduce the probability of centrifugal forces causing spice cans to slide toward space insert openings.

Another object is to obtain prior objects, together with versitility of numbers of tiers.

Other objects become apparent from the following disclosure and preceding discussion.

One or more objects are obtained by the invention disclosed herein, illustrated by the Figures of a preferred embodiment which is not intended to illustrate all possible variations, but which Figures are for the sole purpose of improving understanding of the invention as embodied in this preferred embodiment.

Accordingly, broadly the invention includes a pigeonhole structure which as a part thereof forms a substantially flat support surface as a bottom to each recessed space for the reception within that space and support on top of that surface, of a spice can having a downwardly-extending flange around the periphery of the can bottom. Extending upwardly from the flat support surface is at least one set of abutments which include at least first and second abutments. The first abutment is positioned to prevent the downwardly-extending flange from sliding further inwardly into the insert space away from the insertion opening thereof. The second abutment is positioned to prevnet the downwardly-extending flange from sliding further outwardly toward the outer edge of the flat support surface at the insertion opening.

In a normal embodiment there would be a plurality of the separate recessed spaces formed, each having its independent insertion opening.

In an embodiment having a large number of such recessed spaces, noting that each space requires optimally the squared corners so as not to have wasted space and to make-for compactness and efficiency of material in the manufacture thereof, adjacent recessed spaces face a common direction, with the inwardly-extending channel of the space extending in a first direction, for example. When arranged about a central point, each imaginary first direction is positioned at about a right angle (i.e. perpendicularly to) a second imaginary line extending through the central point, typically in such arrangement the pigeonhole structure being mounted for pivotal movement in a rotary fashion around the central point, rotational along a substantially horizontal plane. More preferably there are two pairs of abutments, one pair on each of opposite sides of the insert opening, such that the spice can is held securely, one pair near one side edge of the can and the other pair near the opposite side edge of the can, position in-front-of and behind preferably the forward-edge flange of the spice can, thereby preventing each of forward and rearward sliding of the spice can further into or out-of the insert opening's recessed space. To further prevent centrifugal forces during rotation from tending to throw-outwardly the respective spice cans mounted within the respective recessed spaces, it is noted that novely by the present arrangement described-above of the first and second imaginary directional line at right angles to one-another, the insert openings of the pigeonhole structure when distant from the central point, at which distant point centrifugal force would be the greatest, the first imaginary line does "not" extend through the central pivot point, whereby the direction of centrifugal force would tend merely to lean the spice can in a side or lateral direction with regard to the location of the insert opening for that insert space; this is in contrast to the insert opening and insertion recessed space thereof when located closest to the central pivot point, at which point the first direction imaginary line would extend through or close to the central pivot point; at such location, while the centrifugal force would be radially outwardly toward the insert opening of that respective recessed space, but at that point the centrifugal force would be at a minimum because of the close proximity of the storage flat support surface to the central pivot point. Accordingly, each of these features alone, as well as the location together with the one or more pairs of upwardly-extending abutments, serve(s) to position any spice can, irrespective of size as well as prevent the same from being inconveniently pushed inwardly too far to reach, or from falling outwardly beyond the edge. While prior art devices have had edge-flanges, such serve to increase the difficulty of removing the spice can, often causing it to be dropped from the fingers of the person. The present invention, as noted above does not have such disadvantages, but does have the advantages noted above.

Together with the above described features, the invention further includes versitility of optional multiplicity of tiers, together with the central pivot structure being preferably also segmented into a series of detachably attached rod members each of which corresponds in length (height) to the height of the recessed spaces of the respective tier, the multiplicity of tiers together with such feature being preferred.

Also, another preferred feature is the convoluted outer edge of the flat support surface of each insert opening, with the convolution extending inwardly thereby providing finger-grasping space, such that grasping of a spice can resting on the support structure is thereby facilitated by the placing of a finger beneath the spice can through the space formed within the convolution.

THE FIGURES

DETAILED DESCRIPTION OF THE INVENTION

Figure 1:
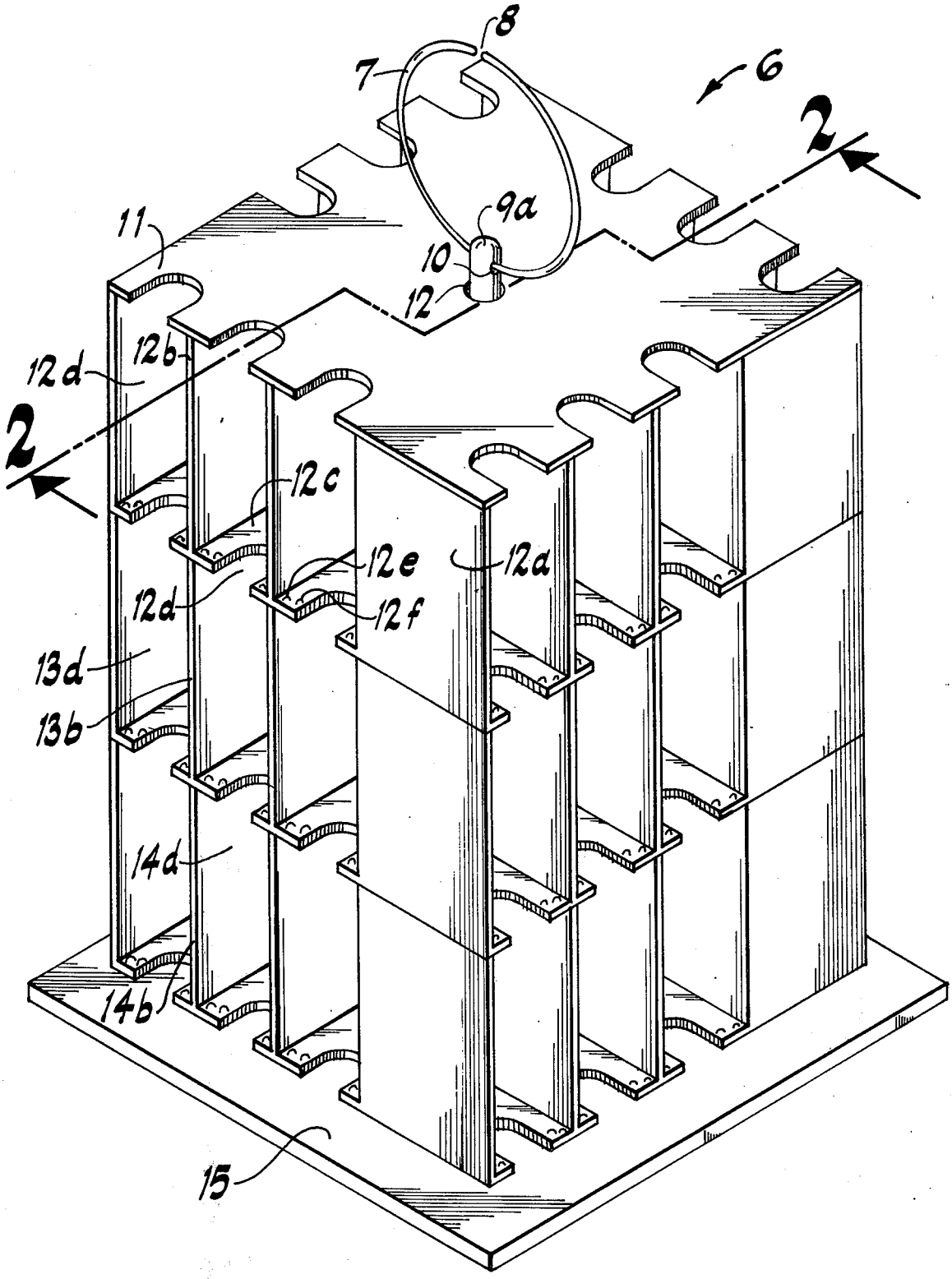
FIG. 1 illustrates in side perspective view a preferred embodiment of the invention.
Figure 2:
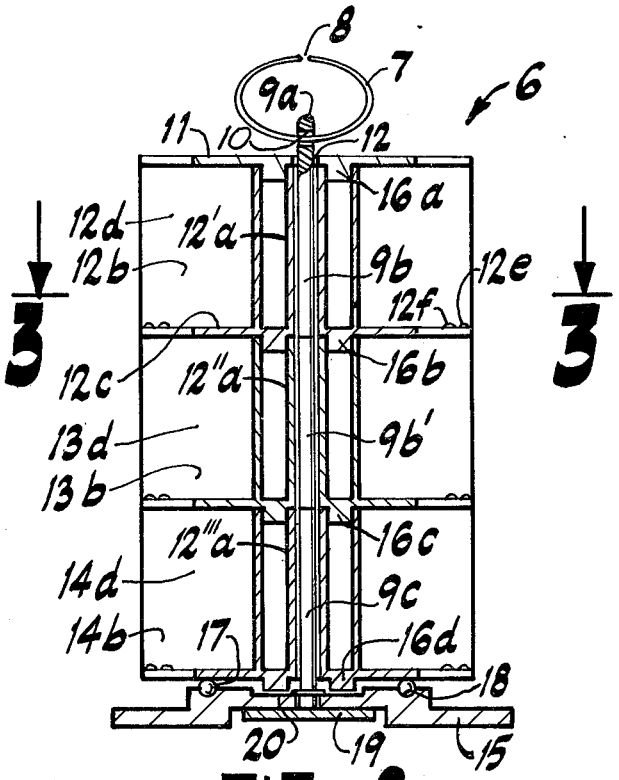
FIG. 2 illustrates a side cross-sectional view as taken along line 2—2 of FIG. 1, giving an upright view thereof.
Figure 3:
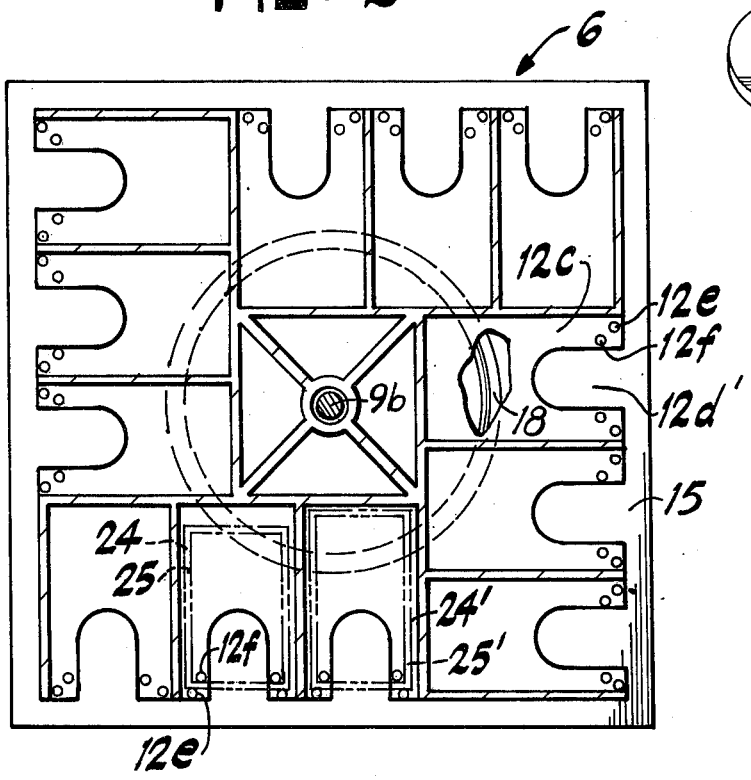
FIG. 3 illustrates a cross-sectional view as taken along line 3—3 of FIG. 2, giving a horizontal view thereof.

In greater detail, FIGS. 1 through 5 show different views above-noted, of a preferred tierred rotatable spice-cans storage unit 6. The oval handle 7 has spacing 8 allowing easy mounting of the handle 7 through the upper-most rod member **9*b* through the through-passage/aperature 10. The central upright support structure includes serially attached rod members 9*b*, 9*b*' and 9*c*, the upper portion of the rod member 9*b* being identified as 9*a*. The top or lid structure 11 has central aperture 12 through which the rod member portion 9*a* extends, and includes downwardly-extending keys 16*a* securing it within central space located centrally of the pigeonhole insert openings and recessed spaces thereof as best seen in FIGS. 2 and 3, the mounted state being shown in FIG. 2. FIGS. 2 and 1 best show the separate tiered portions, each tier including a separate set of pigeonhole structure and the recessed spaces thereof, arranged typically as shown in the FIG. 3 illustration. Each tier is unitary in structure, molded as such thereby reducing cost of production, each tier being a replica of other tiers. Each tier also has its respective downwardly-extending keys such as keys 16*b* and 16*c* and 16*d*, and each having its respective central structure tubular in nature having its central aperture 12. The respective central tubular structures 12', 12'', and 12''' are shown in FIG. 2, with the rod members 9*b*, 9*b*' and 9*c*** extending therethrough.

Figure 4:
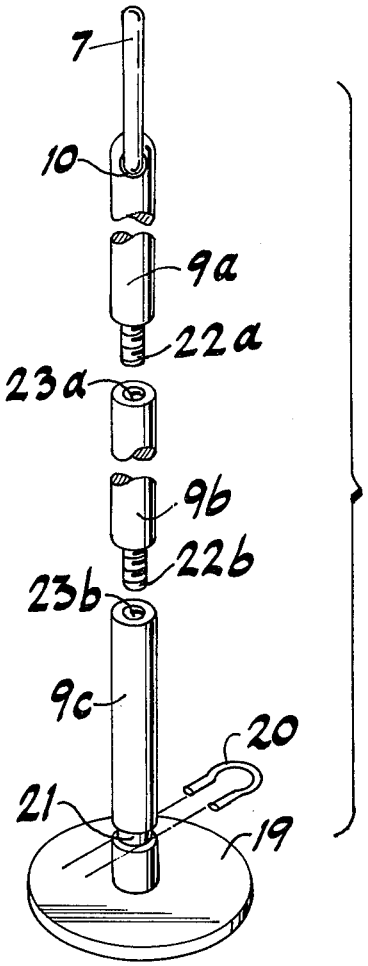
FIG. 4 illustrates a side perspective view of the upright segmented support, illustrating the detachably attached rod members thereof, and the base-fastening pin(key).

The lower rod member **9*c* shown in FIG. 4, includes a stepped portion 21 which receives lock key 20, and has base member 19, thereby lockable of the base member with a bottom recess of the bottom plate 15. The bottom plate 15 has groove 18 circular in nature as shown in FIGS. 2 and 3, within which the bearings 17 ride thereby providing for bearing rotary movement of the bottom-most flat support surface's structure as shown in FIG. 2**.

Each tier's pigeonhole structure includes a flat support surface **12*c*, and upright side walls 12*d*, 13*d*, 14*d* and the like, and respective recessed spaces 12*d*, 13*d*, 14*d*, and the like, best seen in FIGS. 1 and 2. FIG. 3 illustrates the convolution in the flat support surface 12*c*, forming finger-space 12*d*'**.

Figure 5:
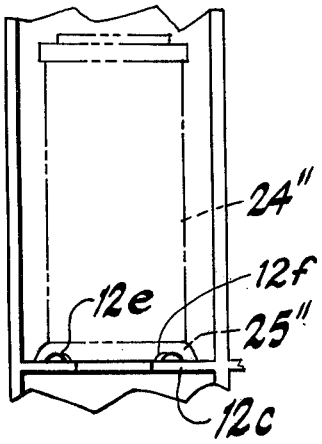
FIG. 5 illustrates a side elevation view of a typical pigeonhole structured insert opening showing in phantom the spice can mounted therein.

As best seen in FIGS. 1, 3 and 4, each flat support surface includes two pairs of upwardly-extending abutments, the first of each pair being identified as abutment **12*f* which prevents the spice can's downwardly-extending peripheral flange from sliding further into the recessed space, and the second of each pair being identified as abutment 12*e* which prevents the spice can's downwardly-extending peripheral flange from sliding further toward the insert opening for the particular recessed space; this relationship is best illustrated by the FIGS. 3 and 5, relative to the different sized spice cans 24, 24' and 24''. For the respective illustrated cans, illustrated in phantom, the downwardly-extending flanges 25, 25' and 25''** thereof are shown as locked in place by the respective sets of upwardly-extending abutments.

The FIG. 4 best illustrates the male members **22*a*, 22*b*, for example, and the corresponding female threaded apertures 23*a* and 23*b* respectively, of the rod members 9*a*, 9*b*, and 9*c*** respectively.

The invention includes all modifications and substitution of equivalents and variations as would be obvious to a person skilled in this art.

We claim:

1. A spice-can storage device comprising in combination: pigeonhole structure forming a recessed space and having upright walls and an overhead wall, and having a flat support surface between the upright walls and having an outer edge to the flat support surface, within the recessed space and forming a single recessed-space opening, and having an outer edge to the flat support surface, and the flat support surface and the recessed space both extending from the single recess-space opening at the outer-edge of the flat support surface, the flat support surface being adapted for supporting a bottom face of a spice can having a continuous peripheral downwardly-extending flange around the periphery of the spice can-bottom, the pigeonhole structure' recessed space and the flat support surface both being of lengths receivable of different ones of spice cans having bottoms of different lengths, the flat support surface having upwardly extending sets of abutments located solely adjacent said single recessed-space opening, the sets including at least a first abutment positioned on an upper surface of the flat support surface at said outer edge adapted for preventing the spice can from being accidentially slid outwardly from the recessed space and a second abutment positioned adjacent to said single opening a predetermined minor distance of a dimension sufficient to form a seating space the second abutment being spaced-away-from each of the upright walls sufficiently to receiving and retainably seating the continuous peripheral downwardly-extending flange, and for the second abutment being positioned to prevent a downwardly-extending spice can flange seated within said seating space from being slid further into said recessed space, whereby a spice can of any size bottom is retainably seatable adjacent to said single recessed space opening.

2. A spice-can storage device of claim 1 in which a central portion of said outer edge is convoluted concavely into the recessed space to a point beyond said second abutment and forms a convolution space of a size sufficiently large such that grasping of a spice-can having its flange seated within said seating space is facilitated.

* * * * *